United States Patent [19]

Dunn

[11] Patent Number: 4,462,187

[45] Date of Patent: Jul. 31, 1984

[54] HEADSETTING STRUCTURE FOR DOUBLE DISC GRINDING MACHINE

[75] Inventor: Elman R. Dunn, Roscoe, Ill.

[73] Assignee: Litton Industrial Products, Inc., South Beloit, Ill.

[21] Appl. No.: 322,987

[22] Filed: Nov. 19, 1981

[51] Int. Cl.[3] ..... B24B 5/00; B24B 41/00

[52] U.S. Cl. ..... 51/111 R; 308/189 R

[58] Field of Search ..... 51/111–118, 51/166 TS, 166 MH, 2 H; 308/189 R, 190, 191

[56] References Cited

U.S. PATENT DOCUMENTS

| | | | |
|---|---|---|---|
| 823,613 | 6/1906 | Miller et al. | 51/166 MH |
| 1,638,028 | 8/1927 | Gardner | 51/111 R |
| 2,072,451 | 3/1937 | Hughes | 308/190 X |
| 2,424,448 | 7/1947 | Gardner et al. | 51/2 H X |
| 2,465,634 | 3/1949 | Collins | 308/190 X |
| 2,580,489 | 1/1952 | Wagner | 308/190 X |
| 3,348,341 | 10/1967 | Dunn | 51/111 R |
| 3,860,293 | 1/1975 | Labeda | 308/190 X |
| 4,054,335 | 10/1977 | Timmer | 308/191 |
| 4,096,906 | 6/1978 | Bonnamour | 308/190 R X |

*Primary Examiner*—Frederick R. Schmidt
*Assistant Examiner*—Debra S. Meislin
*Attorney, Agent, or Firm*—Spencer T. Smith

[57] ABSTRACT

A double disc grinding machine comprising a wheelhead assembly, a base for supporting the wheelhead assembly for axial displacement relative thereto, the base including a front wall having a front trunnion secured thereto and extending horizontally therefrom, and a rear wall having a rear trunnion secured thereto and extending horizontally therefrom in coaxial relation with the front trunnion, and a principal machine frame including front and rear walls, the machine frame rear wall supporting the rear trunnion for pivotal displacement about its axis and for limited pivotal displacement about a mutually perpendicular vertical axis and structure for horizontally displacing the rear supporting structure along the rear wall of the frame thereby angularly displacing the front trunnion, and the machine frame front wall supporting the front trunnion for pivotal displacement about its axis and for limited pivotal displacement about a mutually perpendicular vertical axis.

3 Claims, 5 Drawing Figures

HEADSETTING STRUCTURE FOR DOUBLE DISC GRINDING MACHINE

Double disc grinding machines use two abrasive disc wheels to remove stock and meet tolerance requirements on two opposite and parallel sides of product components or workpieces.

In double disc grinding machines, the angular relationship between the abrasive disc wheels, which are components of opposing wheelhead assemblies, must be readily and conveniently changeable as required to produce optimum grinding performance. This procedure, which is generally referred to as headsetting (wheelhead setting), includes a vertical-plane (tilt) setting and a horizontal-plane (swivel) setting, usually to the same degree with regard to each disc face.

It is exceedingly important that precise and secure headsetting adjusting means be available, and that the as-adjusted angular headsettings remain virtually constant during ensuring grinding operations upon product components.

U.S. Pat. No. 1,638,028, issured Aug. 9, 1927, discloses a double disc grinding machine having a sub-base which is pivotally mounted on a knee for relative movement about a vertical axis with the knee pivotally mounted on a base for relative movement about a horizontal axis. A wheelhead assembly is supported for axial displacement on suitable sub-base ways or guides. A double disc grinding machine having upper and lower base parts mounted together for relative movement about vertical and/or horizontal axes is disclosed in U.S. Pat. No. 2,424,448, issued on July 22, 1947.

In the double disc grinding machine disclosed in U.S. Pat. No. 3,348,341, issued on July 16, 1964, headsetting is achieved by changing the axis of the wheelhead spindle relative to its housing.

It is an object of the present invention to provide an improved headsetting arrangement for a double disc grinding machine.

Other objects of the present invention will become apparent from the following portion of the specification and from the accompanying drawings which illustrate, in accordance with the mandate of the patent statutes, a presently preferred embodiment incorporating the principles of the invention.

Referring to the drawings.

Figure 1:
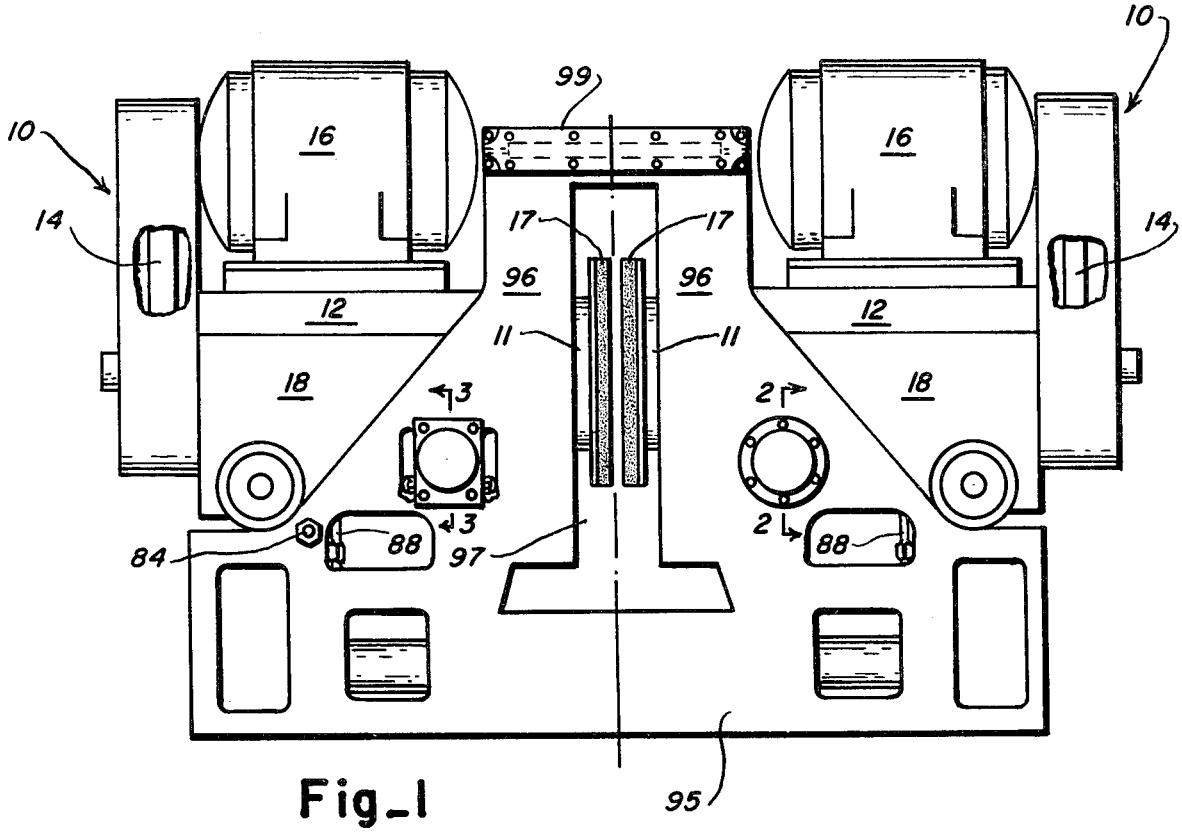
FIG. 1 is a one half front and one half rear elevational view of a double disc grinding machine made in accordance with the teachings of the present invention the other unshown halves are mirrored images of the shown halves.

A double disc grinding machine generally comprises opposing wheelhead assemblies 10, each including a spindle 11 rotatably mounted in an axially slidable housing 12 and driven, via belts 14, by a motor 16 secured to the slidable housing. An abrasive disc wheel 17 is secured to each spindle for effecting stock removal from one of the two opposite flat and parallel surfaces of a workpiece.

The wheelhead assemblies are each supported on ways established on a base member 18 for sliding axial displacement toward and away from the workpiece. Each base member includes opposing side walls 20 (one shown) which have secured thereto coaxial trunnions 22, 23 (FIGS. 2 and 3) which are pivotally supported by upwardly projecting front and back walls 25 of the main machine foundation or frame structure.

The trunnions 22, 23 are supported for limited pivotal movement in ball bearing supports 30, each of which includes a face-to-face mounted pair of ball bearings 32 separated by a cylindrical spacer element 34 having a width selected to locate the bearing load centers P coincident on the axis of rotation of the trunnion. This permits the rear trunnion bearing assembly to be deliberately displaced slightly radially with respect to the front trunnion assembly by shifting the rear pivotal support, FIGS. 3 and 4, longitudinally along the rear wall of the base without damaging either bearing. Both front and rear trunnions, and the base member 18 to which both trunnions are attached, accordingly will thus be pivotally displaced in a horizontal plane, thereby effecting a swivel adjustment, of the total wheelhead assembly 10.

Figure 2:
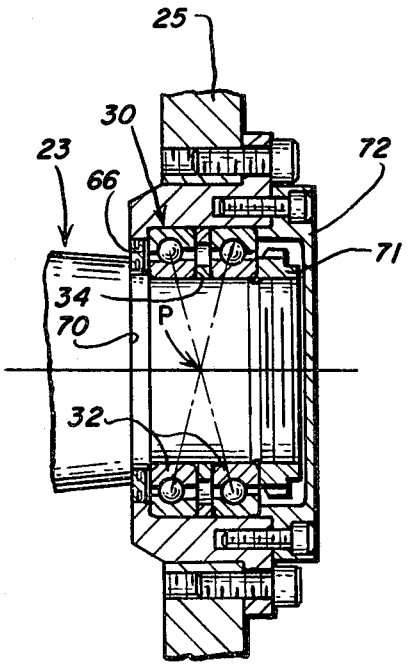
FIG. 2 is a view taken along the lines 2—2 of FIG. 1 illustrating the front pivotal support for a wheelhead assembly of the double disc grinding machine illustrated in FIG. 1.

When such an adjustment is performed, the true pivot point P about which the wheelhead assembly is being swivelled is the front trunnion bearing load-center which lies coincident with the axis of the front trunnion 23, FIG. 2, as controlled by the axial thickness of spacers 34.

Figure 3:
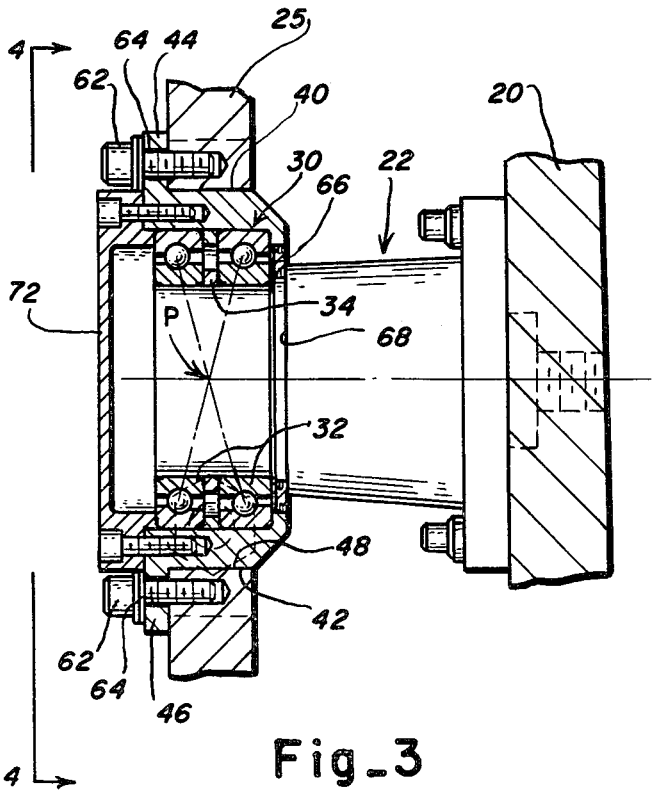
FIG. 3 is a view taken along the lines3—3 of FIG. 1 similar to that of FIG. 2, but illustrating the rear pivotal support for the wheelhead assembly.
Figure 4:
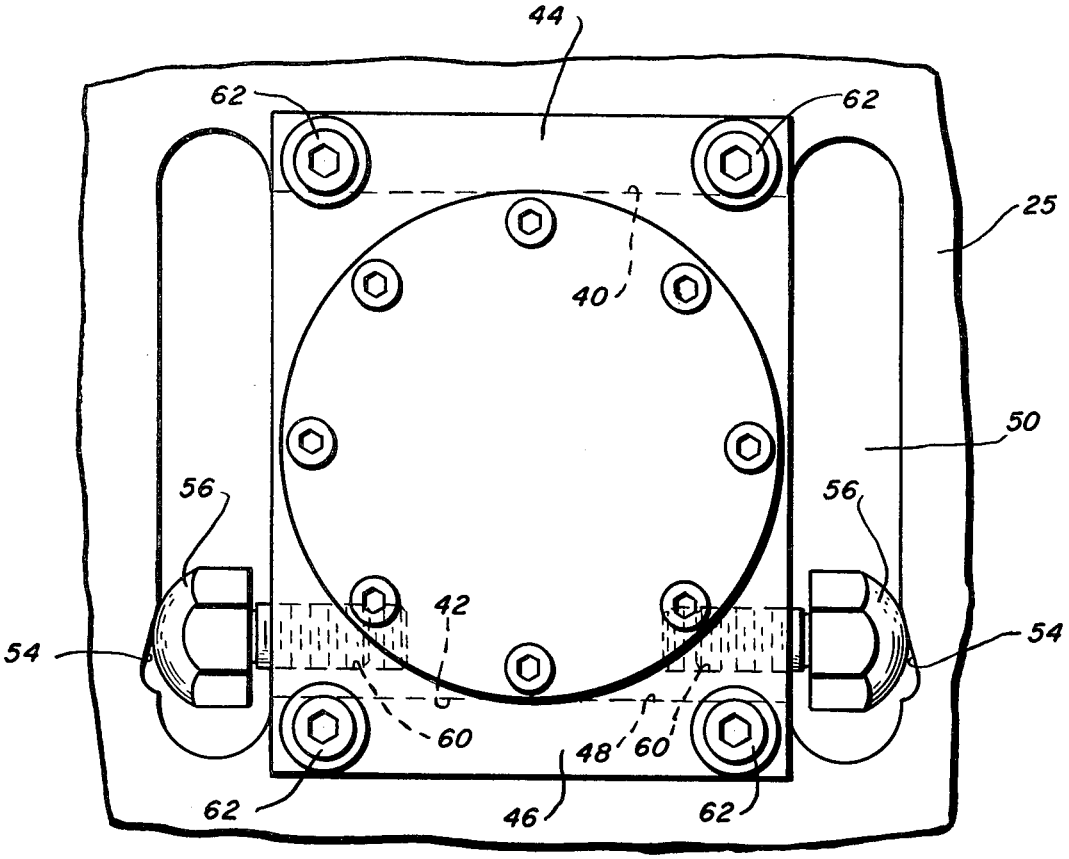
FIG. 4 is a view taken along lines 4—4 of FIG. 3 showing the adjusting means for adjusting the horizontal-plane (swivel) headsetting component.

The rear trunnion ball bearing support shown in FIG. 3 includes upper and lower horizontal 40, 42 surfaces and upwardly and downwardly extending flange portions 44, 46. The lower horizontal bearing support surface 42 slidingly engages with the lower 48 horizontal surface of back wall opening 50 of the machine frame.

The rear wall opening 50 (FIG. 4) extends beyond the bearing support and includes selectively inclined surfaces 54 at either end of this opening. The spherical heads 56 of opposed swivel adjustment screws threadedly secured in suitable bearing support bores 60 are forcefully adjusted against these inclined surfaces to establish a selected longitudinal location of the bearing support along the machine frame. The forceful engagement between the spherical heads 56 of the adjusting screws and inclined surfaces 54 produces a downward force through the rear bearing housing to effectively clamp surface 42 against surface 48 of the machine frame.

The rear bearing support is fixedly secured to the rear wall of the machine frame by belleville spring washer preloaded screw assemblies 62. Such screws pass through openings 64 in the bearing support flanges 44 and 46 which are substantially larger than the screws body diameters, thereby permitting limited longitudinal adjustment of the bearing support within wall opening 50.

Since a clearance type of annular seal member 66 is provided between the trunnion shoulders 68, 70 and the bearing support, limited reorientation is possible.

The front trunnion bearing assembly, which is illustrated in FIG. 2, does not require swivel adjustment facility. A nut 71 threadedly secured to the threaded end of the front trunnion 23 fixedly axially clamps the front trunnion and the entire wheelhead assembly thereby at a fixed transverse location with respect to the machine frame. Suitable covers 72 axially clamp each pair of trunnion bearings outer races under heavy-preload status in each bearing housing to eliminate all internal looseness of the bearings elements.

Figure 5:
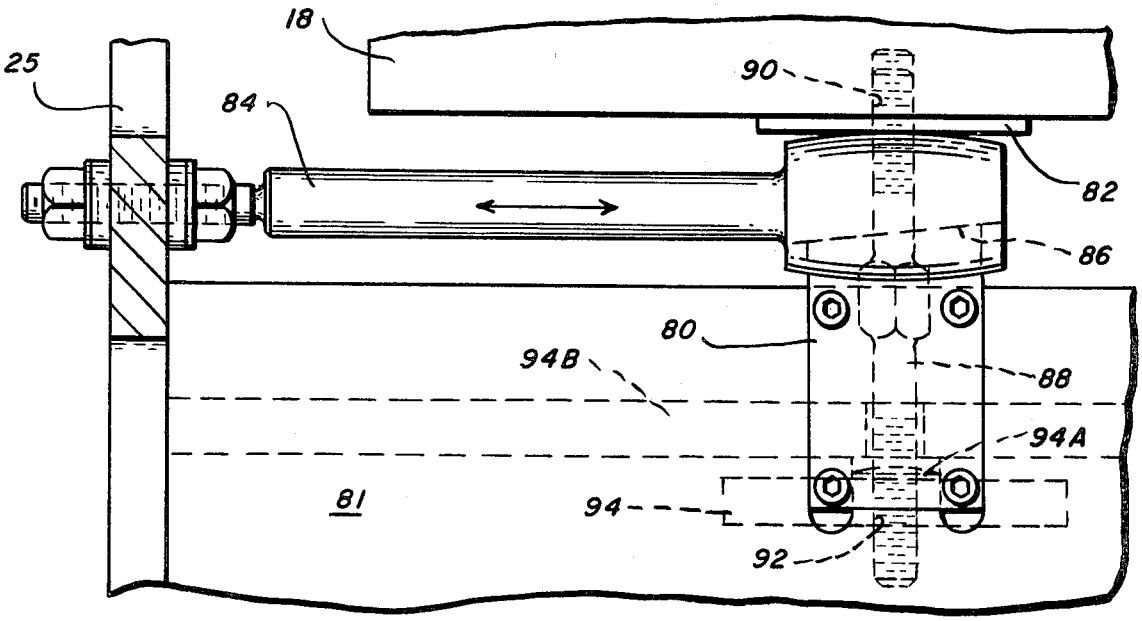
FIG. 5 is a side elevational view of the tilt adjusting assembly for the double disc grinding machine.

To control the tilt of each stock removal assembly, a tilt control assembly (FIG. 5) including a cam element 80 secured to a transverse frame wall 81, a plate 82 secured to the bottom of the adjustable base member 18 which supports the slidable spindle housing, and an axially adjustable control rod 84 having a crowned barrel end with a full-length cam follower surface 86 is provided. The left hand end of control arm 84 is threaded and a pair of bolts 85 on either side of wall 25 secure the control arm 84 at a desired location. To shift the control arm 84 to the left, the right hand of the two nuts 85 is rotated to the right (loosened) and the left nut is tightened. As the control arm is shifted axially left to right or right to left, the cam 80, which is a plate member having an inclined surface 86, will raise or lower the right hand end portion of the control arm 86 which is in the form of a cylindrical element having a mating slot defined therein raising or lowering the base member. Adjustment may be maintained with a clamp screw 88 which has it opposing ends threadedly received by a right-hand threaded aperture 90 in the base member 18 and a left-hand threaded aperture 92 in a bar nut 94 which draws tightly upward against a spherical washer assembly 94A underneath a transverse member 94B of the machine frame. This effectively clamps the wheelhead assembly downward upon the machine frame structure, to insure metal-to-metal contact at all adjoining surfaces of the adjusting mechanism.

The front and back walls of the machine frame (FIG. 1) have an elongated bottom portion 95 and an upwardly extending tapered portion 96. A vertical opening 97 permits the feeding of workpieces into the grinding zone between the opposed abrasive discs.

The top portion 98 of the front and rear walls above the vertical openings 97 is integral with the upwardly extending portions of the front and back walls 25 and are further strengthened by securing thereto a heavy tensile bolster 99.

What is claimed is:

1. A double disc grinding machine comprising a wheelhead assembly, base means for supporting said wheelhead assembly for axial displacement relative thereto, said base means including a front wall having front trunnion means secured thereto and extending horizontally therefrom, and a rear wall having rear trunnion means secured thereto and extending horizontally therefrom in coaxial relation with said front trunnion means, and a principal machine frame including front and rear walls, said machine frame rear wall including means for supporting said rear trunnion means for pivotal displacement about its axis and for limited pivotal displacement about a mutually perpendicular vertical axis, said rear trunnion supporting means comprising a face-to-face mounted pair of ball bearings; and spacer means having a width selected to locate the bearing load centers of said all bearings coincident on the axis of rotation of said trunnions, and means for horizontally displacing said rear trunnion supporting means along the rear wall of said machine frame thereby horizontally displacing said rear trunnion means, and said machine frame front wall including means for supporting said front trunnion means for pivotal displacement about is axis and for limited pivotal displacement about a mutually perpendicular vertical axis, said front trunnion supporting means comprises a face-to-face mounted pair of ball bearings; and spacer means having a width selected to locate the bearing load centers of said ball bearings coincident on the axis of rotation of said trunnions whereby horizontal displacement of said rear trunnion will conjointly cause a pivoting of said front and rear trunnions about vertical axes passing through said points of coincidence thereby effecting a swivel adjustment for said stock removal assembly.

2. A double disc grinding machine according to claim 1 wherein said displacing means comprises a pair of opposing coaxial spherical headed screws selectively engaging tapered surfaces in said rear wall of said principal machine frame.

3. A double disc grinding machine according to claim 1 further comprising means for tilting said base means about the axis defined by said front and rear trunnion means including a stationary cam secured to said machine frame and an axially adjustable control member.

* * * * *